US005836706A

United States Patent [19]

Ruhe

[11] Patent Number: 5,836,706

[45] Date of Patent: Nov. 17, 1998

[54] MEDIA HANDLING SYSTEM FOR DUPLEX PRINTING

[75] Inventor: Thomas W. Ruhe, LaCenter, Wash.

[73] Assignee: Hewlett-Packard Company, Palo Alto, Calif.

[21] Appl. No.: 986,722

[22] Filed: Dec. 8, 1997

[51] Int. Cl.[6] ..... B41J 13/02; B65H 29/00

[52] U.S. Cl. ..... 400/636; 101/230; 101/231; 271/902; 271/186

[58] Field of Search ..... 101/229–230, 101/231; 271/902, 186, 303; 400/634, 636, 578

[56] References Cited

U.S. PATENT DOCUMENTS

| | | | |
|---|---|---|---|
| 4,202,266 | 5/1980 | Zahradnik | 101/218 |
| 4,453,841 | 6/1984 | Bobick et al. | 400/126 |
| 4,956,678 | 9/1990 | Kiya et al. | 355/318 |
| 5,011,313 | 4/1991 | Sato | 400/605 |
| 5,155,540 | 10/1992 | Yamada et al. | 355/319 |
| 5,158,380 | 10/1992 | Hauslaib et al. | 400/605 |
| 5,158,381 | 10/1992 | Inomata et al. | 400/605 |
| 5,201,517 | 4/1993 | Stemmle | 271/291 |
| 5,225,881 | 7/1993 | Goto et al. | 355/319 |
| 5,308,175 | 5/1994 | Ito | 400/605 |
| 5,374,049 | 12/1994 | Bares et al. | 271/186 |
| 5,447,303 | 9/1995 | Smith | 271/291 |
| 5,517,228 | 5/1996 | Obu et al. | 347/171 |
| 5,530,522 | 6/1996 | Tsunemi | 355/208 |
| 5,594,486 | 1/1997 | Kiyohara | 347/104 |
| 5,680,651 | 10/1997 | Tsuji et al. | 399/401 |
| 5,708,953 | 1/1998 | Morigami et al. | 399/364 |
| 5,730,535 | 3/1998 | Keller et al. | 400/605 |

*Primary Examiner*—Edgar Burr
*Assistant Examiner*—Dave A. Ghatt

[57] ABSTRACT

During first side printing, a media sheet is fed along a feed roller over a refeed guide toward a metering roller and into a print zone. As the trailing edge approaches a metering pinch line, the metering roller stops. After a drying time, the rollers reverse direction. The refeed guide directs the media sheet around the metering roller onto an inner guide having a reversible roller. When the trailing edge of the media sheet clears the refeed guide, the reversible roller is moved into contact with the metering roller causing such roller to reverse direction. The media sheet now moves back along the inner guide onto the feed roller. When the media sheet trailing edge is detected at the feed roller, the feed roller and metering roller change direction back to the original direction. The media sheet now is fed through the print zone for second side printing.

14 Claims, 4 Drawing Sheets

FIG. 5
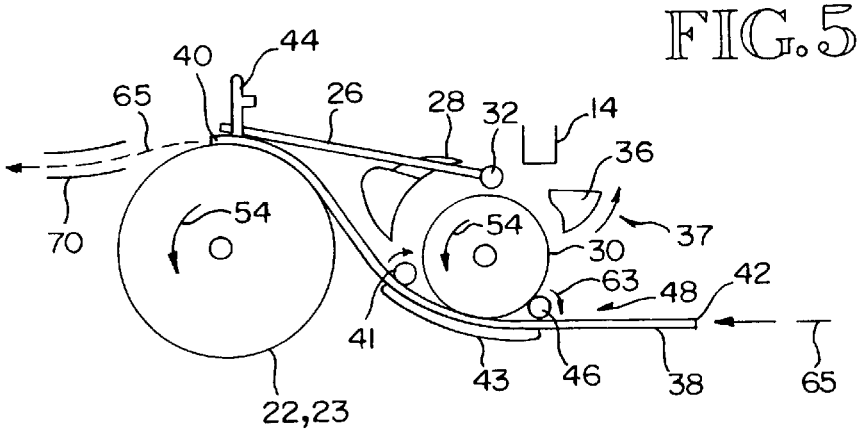
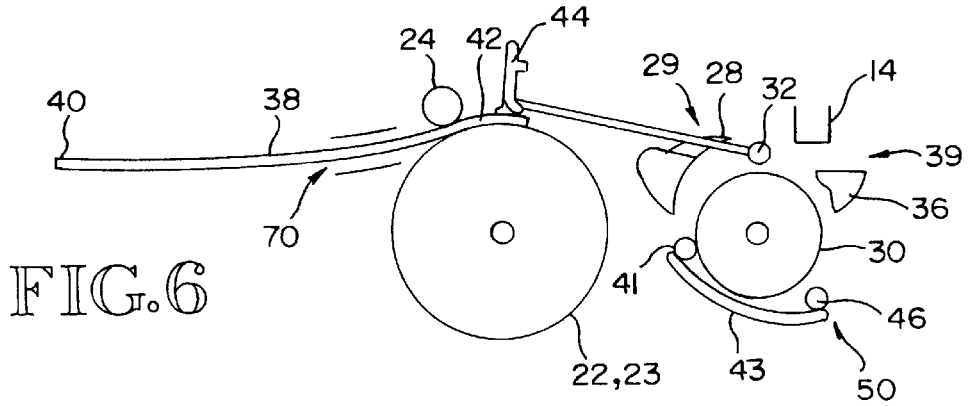
FIG. 6
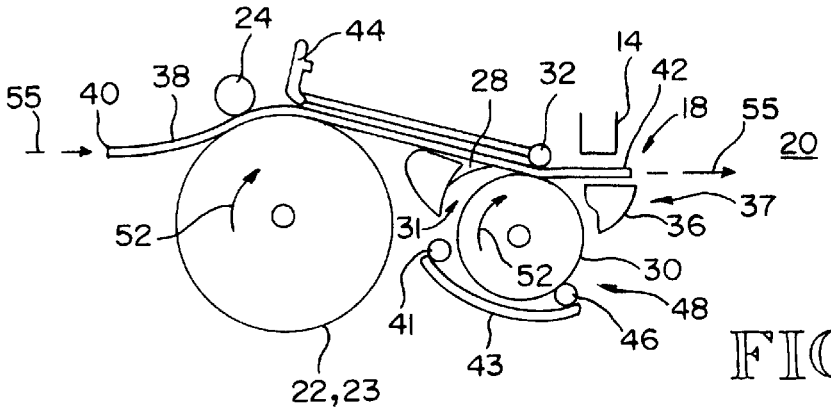
FIG. 7

MEDIA HANDLING SYSTEM FOR DUPLEX PRINTING

BACKGROUND OF THE INVENTION

This invention relates generally to methods and apparatus for printing on two sides of a media sheet, and more particularly, to a media handling system which first feeds a media sheet with a first side exposed to a print source, then feeds the media sheet with a second side exposed to the print source.

Printing to two sides of a media sheet, referred to as duplex printing, is a desirable feature in printing systems. The advantages of duplex printing include reducing the amount of paper required compared to one-sided (simplex) printing, and generating print sets with layouts resembling that of professionally printed books. Conventional duplex printing devices employ complex paper handling mechanisms. Typically, an extra tray is used for temporary storage of pages having printing on a first side. In an alternative approach a second paper path is provided to route a first printed page around the existing paper supply.

Similarly, duplex copying typically is accomplished by either one of two methods. In one method, first side copies are stacked in a duplex tray. When a set of first side copies is complete, the copies are fed out of the duplex tray and returned with an odd number of inversions along a duplex path to receive second side imaging. In an alternative method first side copies are returned directly to receive second side imaging without stacking.

Conventional devices tend to have long paper paths and many parts. It is desirable to achieve a simplified method and apparatus for duplex media handling at a desktop printer.

SUMMARY OF THE INVENTION

According to the invention, duplex printing is achieved for a desktop printer, such as an inkjet printer. The inkjet printer includes a feed roller and a metering roller which move a media sheet along media paths during first-side printing, media sheet flipping and second-side printing. Printing and media sheet flipping are achieved without rotating such rollers in opposing directions.

According to one aspect of the invention, a refeed guide is included along a first media path downstream from the feed roller, between the feed roller and the metering roller. For first side printing, the media sheet is picked then fed along the feed roller and directed by an upper feed guide over the refeed guide to the metering roller. A pinch roller is located adjacent to the metering roller. The media sheet is metered by the metering roller through a print zone into an output region of the printer. The print zone is down stream of the metering roller. A first edge of the media sheet serves as a lead edge during printing to the first side. As the second edge, serving as the trail edge of the media sheet, approaches the pinch line formed between the metering roller and a corresponding pinch roller, the metering roller stops. At such time, first side printing is complete and the lead edge of the media sheet extends into the output region of the desktop printer. For an inkjet printer, the first side of the media sheet now is given time to dry in the air space of the printer output region.

According to another aspect of the invention, to flip the media sheet after first side printing is complete, the rotation of the first roller and metering roller reverse to an opposite direction than the original rotational direction. With the second edge of the media sheet between the pinch roller and metering roller, the metering roller moves the media sheet back toward the refeed guide. The second edge now serves as the lead edge as the media sheet is moved back. As the metering roller moves the media sheet back, the refeed guide blocks the media sheet's second edge from traversing back along the original media path. Instead the refeed guide directs the second edge downward toward a first idler roller and an inner guide. The media sheet is fed around the metering roller along the inner guide between the first idler roller and the metering roller toward a second idler roller.

The media sheet second edge passes between the second idler roller and the inner guide and moves away from the metering roller as the metering roller continues reverse rotation. In one embodiment the media sheet second edge moves into an input tray of the printer. After the trailing first edge of the media sheet passes beyond the first idler roller, the second idler roller is moved into contact with the metering roller causing the second idler roller to be driven in a reverse direction. Previously the second idler roller was rotating in one direction under the force of the media sheet being driven between the second idler roller and the inner guide. Once the trail first edge clears the first idler roller, the media sheet is no longer in contact with the metering roller and thus is no longer driven. When the second idler roller moves into contact with the metering roller, the second idler roller begins driving the media sheet back along the inner guide. Thus, the media sheet reverses direction. The first edge as the lead edge moves between the inner guide and the first idler roller. Note that the media sheet now is moving under the first idler roller adjacent to the inner guide, whereas earlier it was moving in the opposite direction between the first idler roller and the metering roller.

The media sheet as driven by the metering roller via the second idler roller moves toward and onto the feed roller. The media sheet first edge moves around the feed roller (which is still rotating in the reverse direction) and out a slot. In moving back toward the feed roller, the media sheet bypasses the feed guide.

As the media sheet is fed back along the feed roller, a media sheet edge is detected by an edge sensor located along the periphery of the feed roller. A print controller responds to the detection signal immediately (e.g., for trail second edge detection) or after a delay (e.g., for lead first edge detection). The response is for the print controller to signal a drive motor to change direction of the feed roller and metering roller back to the original rotational direction. The feed roller thus drives the media sheet forward over the refeed guide toward the metering roller with the media sheet second edge as the lead edge. In effect, the media sheet has been flipped and now moves forward again along the media path into the print zone for second side printing, and onward to the printer output region.

Because the feed roller and metering roller are driven in the same direction at all times, one of the advantages of the invention is that a simpler gearing mechanism is able to be used for driving the feed and metering rollers. Another advantage is that the media sheet is not released between the time the first side is printed and the time the media sheet starts to be re-fed back toward the upper feed guide and first roller. Another advantage is that a drying time is included for wet ink printing to allow time for the first side of the media sheet to dry before printing to the second side of the media sheet. These and other aspects and advantages of the invention will be better understood by reference to the following detailed description taken in conjunction with the accompanying drawings.

BRIEF DESCRIPTION OF THE DRAWINGS

FIG. 5 is a diagram of the media handling components of FIG. 3 showing the media sheet being fed back to the feed roller after the media sheet has been flipped;

FIG. 6 is a diagram of the media handling components of FIG. 3 showing the media sheet being refed along the first path after being flipped;

FIG. 7 is a diagram of the media handling components of FIG. 3 during feeding of a media sheet along a first path for printing to the second side of the media sheet.

DESCRIPTION OF SPECIFIC EMBODIMENTS

Overview

Figure 1:
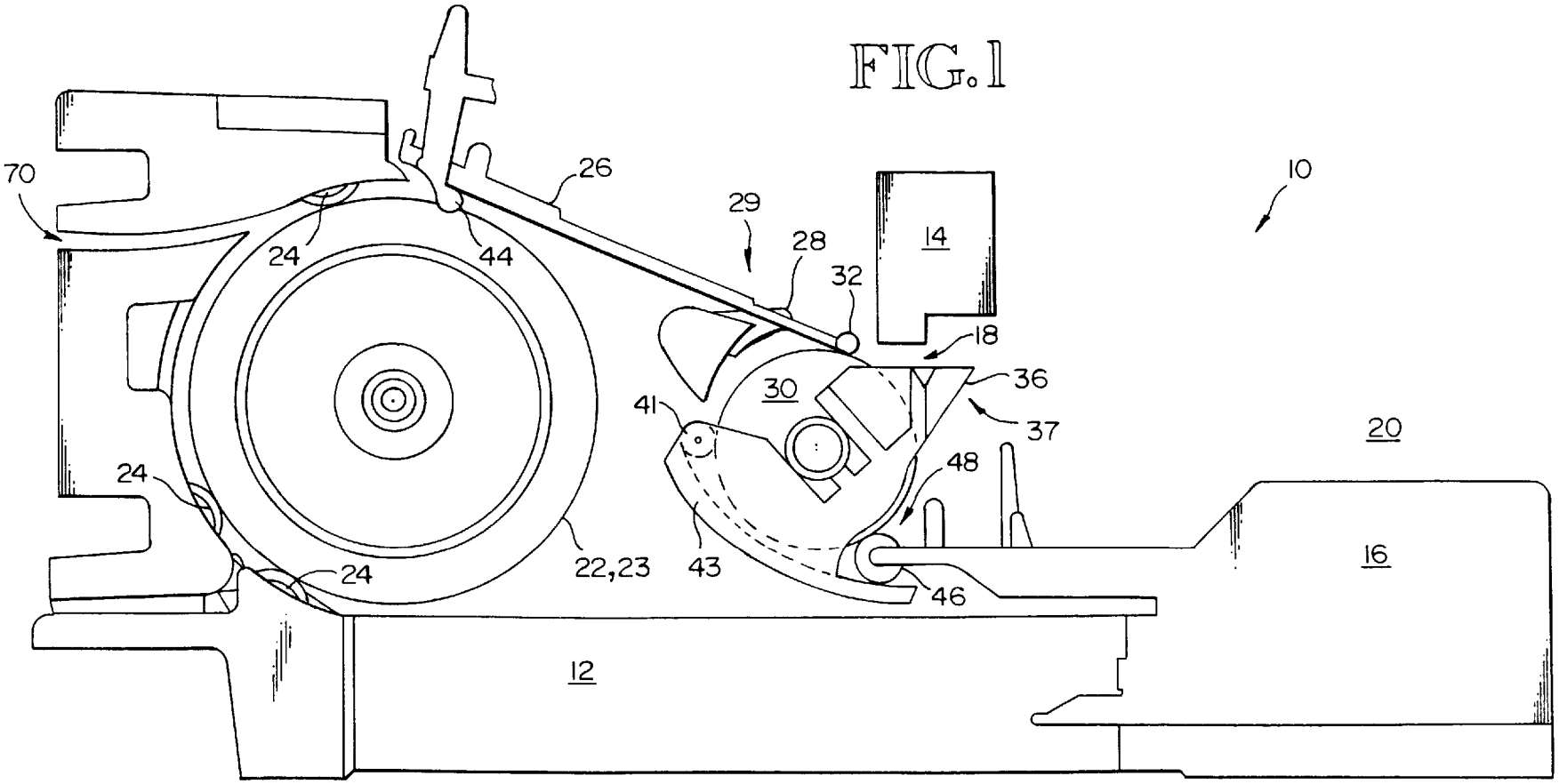
FIG. 1 is a planar side view of a portion of an inkjet printer according to an embodiment of this invention.

FIG. 1 shows an inkjet printer 10 according to an embodiment of this invention. The printer 10 includes a media handling system for routing a media sheet to print first to one face of the media sheet (i.e., first side), then to an opposite face of the media sheet (i.e., second side). The. printer 10 includes an input tray 12, the media handling system, one or more inkjet pens 14, and an output tray 16. A media sheet is picked from the input tray 12 and fed along a media path by the media handling system to a print zone 18 where a first face of the media sheet receives print. During such feed and print operations a first edge of the media sheet serves as a lead edge and a second edge serves as a trail edge. The media sheet continues along the media path into an output region 20 above the output tray 16. For single sided printing, the media sheet is released into the output tray 16. For two sided printing (also referred to as duplex printing), the media sheet is not released into the output tray 16. Instead the media sheet is moved back in the media handling system with the second edge now serving as the lead edge and the first edge now the trail edge. When the media sheet again advances into the print zone, the second face receives print. The media sheet then is fed into the output region 20 and the output tray 16.

Media Handling System and Method for Duplex Printing

Referring to FIGS. 1–8, the media handling system includes pick and feed rollers 22, 23, feed idler rollers 24, an upper feed guide 26, a refeed guide 28, metering rollers 30, metering pinch rollers 32, and a pivot mechanism 36. The pick and feed rollers 22, 23 and the metering rollers 30 are driven by a drive motor 60 via gear transmission 64 (see FIG. 2). According to an aspect of this invention, the rollers 22, 23, 30 are driven in common directions during all steps of simplex and duplex printing. Thus, the gear transmission 64 need not implement linkage for driving the rollers 22,23 in an opposite direction from the metering rollers 30.

Figure 2:
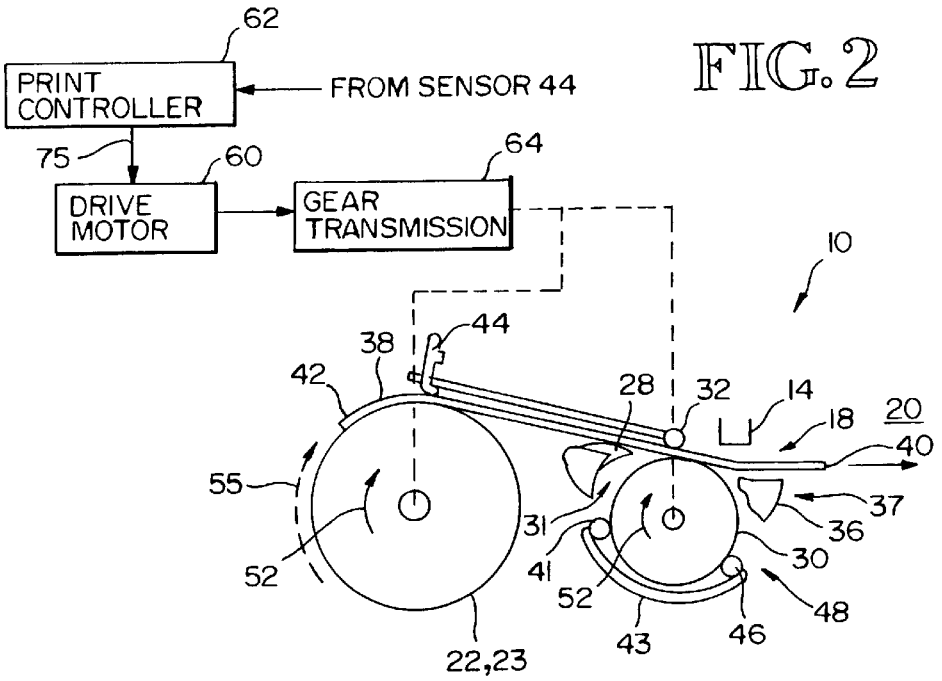
FIG. 2 is a diagram of print drive components and media handling components of FIG. 1 during feeding of a media sheet along a first path for printing to a first side of the media sheet.
Figure 3:
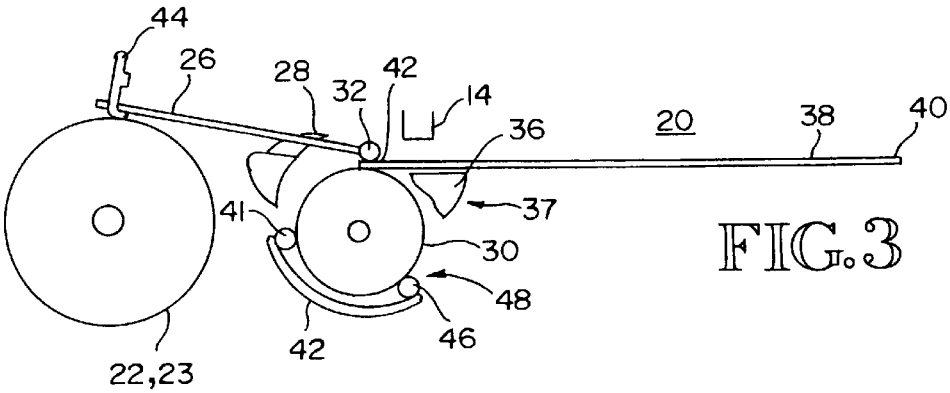
FIG. 3 is a diagram of the media handling components of FIG. 1 at a time between first side printing and second side printing.
Figure 4:
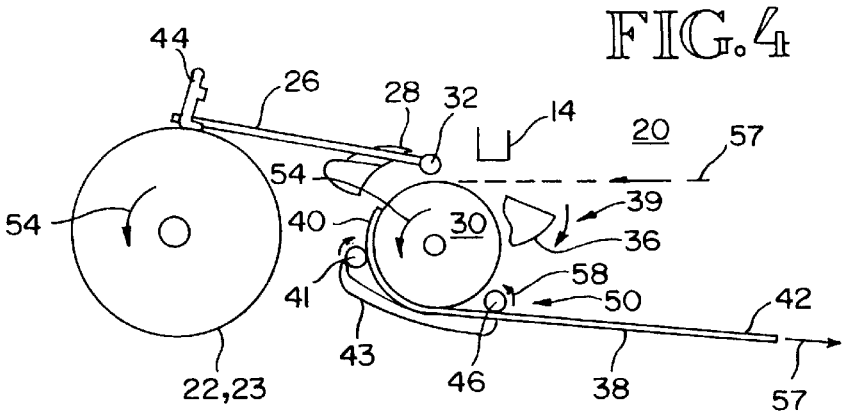
FIG. 4 is a diagram of the media handling components of FIG. 3 in the process of moving the media sheet along a second path for flipping the media sheet.
Figure 8:
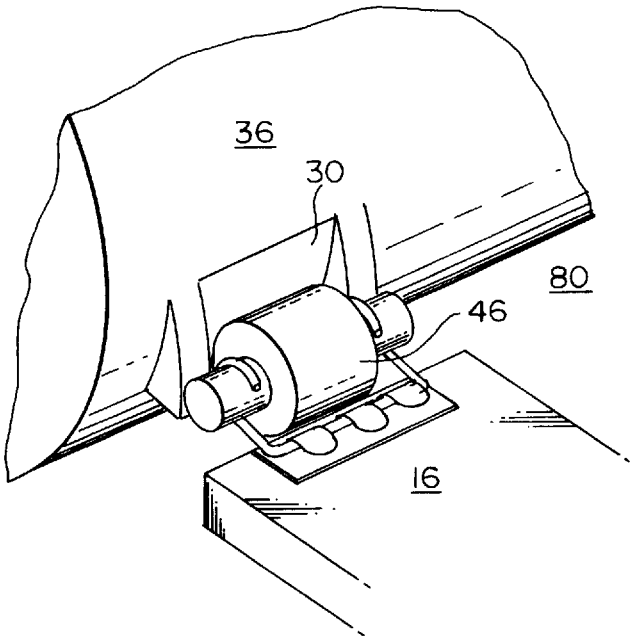
FIG. 8 is a perspective view of the pivot mechanism and reversible roller of FIG. 1.

The refeed guide 28 is movable between a first position 29 and a second position 31, and is biased by gravity into the first position 29. FIG. 1 shows the refeed guide 28 in the first position 29. FIGS. 2 and 6 show refeed guide 28 in the second position 31. The pivot mechanism 36 is coupled to the metering roller 30 and moves between a first position 37 and a second position 39. FIGS. 1, 2, 3, 5 and 7 show the pivot mechanism in the first position 37. FIGS. 4 and 6 show the pivot mechanism in the second position 39. While the pivot mechanism is in the first position 37, a print zone 18 is formed between the pivot mechanism 36 and the inkjet pen 14. The media handling system also includes an idler roller 41 and an inner guide 43 as shown in FIGS. 1 and 8. In addition, a reversible idler roller 46 is coupled to the output tray 16. The reversible idler roller 46 is movable between a first position 48 and a second position 50. Roller 46 is spring-biased into the first position 48. The movement of the pivot mechanism 36 into the pivot mechanism second position 39 moves the idler roller 46 into the idler roller 46 second position 50.

Duplex printing according to one embodiment of the inventive method is described below with regard to FIGS. 1–7.

First Side Printing

A media sheet 38 is picked from the input tray 12 by the pick roller 22. The pick and feed rollers 22, 23 rotate in a first direction 52 feeding the media sheet 38 around the pick and feed rollers 22, 23 along a first media path. Initially, the refeed guide 28 is in the first position 29 (see FIG. 1). A first edge 40 of the media sheet 38 serves as the lead edge as the media sheet 38 is fed along the media path toward the print zone 18. As the media sheet 38 is fed around the pick and feed rollers 22, 23 the upper feed guide 26 directs the media sheet toward the refeed guide 28 and the metering rollers 30. The first edge 40 of the media sheet encounters the refeed guide 28 in the media path. The movement of the media sheet in a first direction 55 into contact with the refeed guide 28 rotates the refeed guide 28 from the first position 29 to the second position 31 (see FIG. 2). The lead first edge 40 then is captured between pinch rollers 32 and the metering rollers 30. The metering rollers 30 rotate in the first direction 52 to meter the media sheet 38 through the print zone 18 into the output region 20. As the media sheet 38 moves through the print zone 18, a first side of the media sheet receives print. As a second edge 42, which is the trail edge, passes beyond the refeed guide 28, the refeed guide 28 rotates under the force of gravity back to its first position 29 (see FIG. 3). An edge sensor 44 detects the passing of the first edge 40, then second edge 42, as the media sheet 38 is fed along the first media path during first side printing. A printer controller 62 receives the edge sensor 44 indications, and determines the media sheet length.

Once the second edge 42 is detected, the metering rollers 30 meter the media sheet 38 a predetermined amount more to complete printing to the first side. The metering rollers 30 then stop the movement of the media sheet 38, while the media sheet 38 in the vicinity of the second edge 42 remains pinched between the metering rollers 30 and the pinch rollers 32 (see FIG. 3). The metering rollers 30 pause rotation for a prescribed time delay for at least partial drying of the media sheet. The print controller 62 outputs control signals 75 to the drive motor to stop rotation for the prescribed drying time and to commence rotation in the reverse direction 54.

Flipping the Media Sheet

The rollers 22, 23, and 30 then reverse direction to rotate in a second direction 54 causing the metering rollers 30 to move the media sheet 38 in a second direction 57 back toward the refeed guide 28. The refeed guide 28 blocks the original media path and guides the media sheet 38 down along a second media path toward a first idler roller 41 and an inner guide 43. The media sheet second edge 42 serving as the lead edge is guided between the idler roller 41 and the metering roller 30 onto the inner guide 43.

During this feeding of the media sheet 38 onto the inner guide 43, the pivot mechanism 36 moves downward away from the pivot mechanism first position 37 toward the pivot mechanism second position 39. Such motion pushes the reversible idler roller 46 into the reversible roller second position 50 away from the metering roller 30. As the media sheet 38 advances on the inner guide 43 in the direction 57, the media sheet second edge 42 encounters the reversible idler roller 46. Such second edge 42 passes between the reversible idler roller 46 and the inner guide 43, and the media sheet 38 is partially fed back into the input tray 12. In an alternative embodiment the media sheet is fed into a shute rather than into the input tray. During this motion the reversible idler roller 46 is driven by the media sheet 38 to rotate in a direction 58 (see FIG. 4). Once the first edge 40 has cleared the first idler roller 41, the media sheet 38, in effect, has been flipped. Next, the media sheet 38 is to be moved back into position to be fed through for second side printing.

After the first edge 40 has cleared the first idler roller 41 and while the media sheet is moving in the direction 57, the pivot mechanism 36 moves upward toward the pivot mechanism first position 37. This motion of the pivot mechanism 36 with its cam 80 releases the reversible idler roller 46, allowing the roller 46 to return to its spring-biased first position 48. The reversible roller 46 thus comes into contact with the metering roller 30. The metering roller 30 drives the idler roller 46 to reverse directions and rotate in a direction 63. By changing directions, the reversible roller 46 changes the direction of motion of the media sheet and drives the media sheet 38 back along the inner guide 43 in a direction 65 (see FIG. 5). The first edge 40 now serves as the lead edge of the media sheet 38 as it moves in direction 65.

The first edge 40 is fed between the first idler roller 41 and the inner guide 43, and advances toward and onto the pick and feed rollers 22, 23 (see FIG. 5). At this time the pick and feed rollers 22, 23, like the metering rollers 30, are still rotating in the second direction 54. The media sheet first edge 40 is picked by the pick roller 22 and fed around the feed rollers 23. The feed roller 23 retracts the media sheet from the inner guide 43 and feeds the media sheet into a slot 70 (see FIGS. 1, 5 and 6). During the feeding of the media sheet in the direction 65, the media sheet first edge 40, then second edge 42, move past the edge sensor 44. According to one embodiment the edge sensor 44 detects the first edge 40. The print controller 62 receives the detection signal and determines when the media sheet second edge 42 is in a desired position. In an alternative embodiment the edge sensor 44 detects the second edge 42 and signals the printer controller 62. The printer controller 62 responds to the signal from the edge sensor immediately or after a delay by outputting a control signal 75 to the drive motor 60 causing the drive motor to change direction and rotate the rollers 22, 23 and 30 in the original direction 52. Such change of direction is timed to occur when the media sheet second edge 42 is at the desired position or at the edge sensor 44. FIG. 6 shows an embodiment where the second edge 42 is at the edge sensor 44 when the drive motor 60 is in the process of changing the directions of the rollers 22, 23 and 30.

Second Side Printing

With the pick and feed rollers 22,23 and the metering rollers 30 now rotating again in the original first direction 52, the media sheet 38 is fed in the first direction 55 along the first media path from the feed rollers 23 to the metering rollers 30 and into the print zone 18 (see FIG. 7). As the media sheet 38 is fed along the first media path, the upper feed guide 26 directs the media sheet 38 toward the refeed guide 28 and the metering rollers 30. The media sheet second edge 42 serving as the lead edge encounters the refeed guide 28 in the media path. The movement of the media sheet in the first direction 55 into contact with the refeed guide 28 rotates the refeed guide 28 from the first position 29 to the second position 31 (see FIG. 7). The lead second edge 42 then is captured between pinch rollers 32 and the metering rollers 30. The metering rollers 30 rotate in the first direction 52 to meter the media sheet 38 through the print zone 18 into the output region 20. As the media sheet 38 moves through the print zone 18, the second side of the media sheet receives print. As a first edge 40, which is the trail edge, passes beyond the refeed guide 28, the refeed guide 28 rotates under the force of gravity back to its first position 29 (see FIG. 3). In one embodiment the metering rollers 30 pause after printing the second side to allow a prescribed time delay for at least partial drying of the media sheet before releasing the media sheet 38 into the output tray 16.

Meritorious and Advantageous Effects

Because the feed roller and metering roller are driven in the same direction at all times, one of the advantages of the invention is that a simple gearing mechanism is able to be used for driving the feed and metering rollers. Another advantage is that the media sheet is not released between the time the first side is printed and the time the media sheet starts to be re-fed back toward the upper feed guide and first roller. Another advantage is that a drying time is included for wet ink printing to allow time for the first side of the media sheet to dry before printing to the second side of the media sheet.

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. A media sheet handling system for moving a media sheet along a first path into a print zone for first side printing, for moving the media sheet along a second path for flipping the media sheet and for moving the flipped media sheet along the first path into the print zone for second side printing, the media sheet having a first edge and a second edge opposite the first edge, the system comprising:

a first roller, a second roller, a third roller, a refeed guide, an inner guide, a first signal, and a second signal;

the first path extending from the first roller to the second roller and into the print zone;

means for rotating the first roller and second roller in a common first direction for first side printing during which the first roller feeds the media sheet along the first path to the second roller and into the print zone, and the second roller receives a lead edge of the media sheet as the media sheet progresses along the first path, the first edge of the media sheet serving as the lead edge during first side printing;

means for discontinuing motion of said second roller in the first direction after printing on the first side is complete and while a portion of the media sheet remains in contact with the second roller;

the refeed guide being located along the first path between the first roller and the second roller and being mounted for movement between a first position and a second position, means biasing the refeed guide toward the first position, wherein in response to the media sheet passing over the refeed guide along the first path moves the refeed guide into the second position;

means responsive to the first signal for triggering the first roller and second roller to change direction to a common second direction while said portion of the media sheet remains in contact with the second roller to cause flipping of the media sheet, the second roller while rotating in the second direction moving the media sheet backward toward the refeed guide which is in the first position, the second edge of the media sheet being the lead edge during movement of the media sheet back toward the refeed guide, means for maintaining the refeed guide in the first position blocking movement of the media sheet along the first path and directing movement of the media sheet toward the second path during flipping of the media sheet;

said third roller being located adjacent to the second roller and the inner feed guide, the third roller movable between a first position out of contact with the second roller and a second position in contact with the second roller;

wherein during movement of the media sheet along the second path, the second roller drives the media sheet along the inner guide between the third roller and the inner guide, the third roller being in the first position;

means for moving the third roller into the second position while the media sheet moves along the inner guide to drive the media sheet back along the inner guide toward and onto the first roller; and wherein for second side printing, means responsive to the second signal triggers the first roller and second roller to change direction back to the common first direction for second side printing after the media sheet clears the inner guide, the first roller moves the media sheet along the first path for second side printing with the media sheet second edge as the lead edge.

2. The system of claim 1, further comprising an output region, wherein the print zone is adjacent to the second roller between the second roller and the output region, and wherein at least a portion of the media sheet is fed through the print zone into the output region during printing; and wherein the media sheet is released into the output region after second side printing.

3. The system of claim 1, further comprising a motor and gear linkage, the gear linkage coupling the motor to the first roller and the second roller, wherein the third roller is not driven while in the third roller first position, and wherein the third roller is driven by contact with the second roller when the third roller is in the third roller second position.

4. The system of claim 3, further comprising a movable pivot mechanism which supports the media sheet while in the print zone, wherein the inner guide and third roller are coupled to the pivot mechanism and move with the pivot mechanism, and wherein movement of the pivot mechanism moves the third roller between the third roller first position and the third roller second position.

5. The system of claim 1, wherein for first side printing, media sheet flipping and second side printing, said mean for rotating said first roller includes the first roller not rotating in a direction opposite the second roller.

6. A media sheet handling method for moving a media sheet along a first path into a print zone for first side printing, for moving the media sheet along a second path for flipping the media sheet and for moving the flipped media sheet along the first path into the print zone for second side printing, the media sheet having a first edge and a second edge opposite the first edge, the method comprising the steps of:

feeding the media sheet with a first roller along the first path over a refeed guide and onto a second roller;

advancing at least a portion of the media sheet with the second roller through the print zone, wherein the first roller and second roller rotate in a common first direction during the steps of feeding and advancing, and wherein the first edge of the media sheet is a lead edge during said feeding and rotating steps;

printing on a first side of the media sheet within the print zone during the advancing step;

after the step of printing on the first side, discontinuing rotation of the second roller while a portion of the media sheet remains in contact with the second roller;

moving the refeed guide into the first path to block the first path in a region between the first roller and the second roller;

rotating the first roller and the second roller in a common second direction opposite the first direction;

during the step of rotating in the common second direction moving the media sheet with the second roller back toward the refeed guide, the refeed guide directs the media sheet onto an inner guide along the second path;

advancing the media sheet along the second path between the inner guide and a third roller, wherein the third roller is located adjacent to the second roller and the inner feed guide, the third roller movable between a first position out of contact with the second roller and a second position in contact with the second roller;

after the step of advancing the media sheet along the second path, moving the third roller into the second position, which in turn causes the media sheet to reverse direction along the second path and move toward and onto the first roller while the first roller is rotating in the common second direction; and after the media sheet clears the inner guide, changing direction of the first roller and second roller back to the common first direction, which in turn causes the first roller to move the media sheet along the first path for second side printing with the media sheet second edge as the lead edge.

7. The method of claim 6, wherein the step of printing on the first side of the media sheet comprises wet ink printing; and wherein after the step of discontinuing rotation of the second roller in the first direction and before the step of rotating the second roller in a second direction, there is a prescribed time delay to allow drying of the media sheet.

8. The method of claim 6, wherein at least a portion of the media sheet is fed through the print zone and into an output region during printing on the media sheet first side and during printing on the media sheet second side; wherein the media sheet resides in the output region for the prescribed drying time delay; and wherein the media sheet is released into the output region after printing on the media sheet second side.

9. The method of claim 6, wherein during the feeding of the media sheet along the first path onto the second roller, the media sheet encounters the refeed guide at a position between the first roller and the second roller, wherein the refeed guide is movable between a first position and a second position and is biased into the first position; wherein during the step of feeding, the lead edge of the media sheet pushes the refeed guide into the second position; and wherein the step of moving the refeed guide into the first path to block the first path occurs after the media sheet clears the refeed guide as the refeed guide is biased back into the first position.

10. The method of claim 6, in which a motor drives the first roller and second roller in the common directions, and in which the third roller is not driven while in the third roller first position, and wherein the third roller is driven by contact with the second roller when the third roller is in the third roller second position.

11. The method of claim 10, in which a movable pivot mechanism supports the media sheet while in the print zone, and wherein the inner guide and third roller are coupled to the pivot mechanism and move with the pivot mechanism, and wherein movement of the pivot mechanism moves the third roller between the third roller first position and the third roller second position.

12. A media sheet handling method for printing on two sides of a media sheet, comprising the steps of:

feeding the media sheet with a first roller along a first path onto a second roller;

rotating the second roller in a first direction to advance at least a portion of the media sheet through a print zone, wherein a first edge of the media sheet is a lead edge and a second edge of the media sheet is a trail edge during said feeding and rotating steps;

sensing the first edge of the media sheet as the lead edge with a sensor;

printing on a first side of the media sheet within the print zone during the rotating step;

sensing the second edge of the media sheet as the trail edge with the sensor;

after the step of sensing the trail edge, determining based upon the lead edge sensing and trail edge sensing when the media sheet first side printing is complete;

after said first side printing is complete, discontinuing rotation of the second roller in the first direction while a portion of the media sheet remains in contact with the second roller;

moving a refeed guide into the first path to block the first path in a region between the first roller and the second roller;

rotating the second roller in a second direction opposite the first direction to move the media sheet back toward the refeed guide, wherein the refeed guide directs the media sheet along a second path onto an inner guide;

advancing the media sheet along the second path between the inner guide and a third roller, wherein the third roller is located adjacent to the second roller and the inner feed guide, the third roller movable between a first position out of contact with the second roller and a second position in contact with the second roller;

after the step of advancing the media sheet along the second path, moving the third roller into the second position, which in turn causes the media sheet to reverse direction along the second path and move toward and onto the first roller while the first roller is rotating in the common second direction; and after the media sheet clears the inner guide, changing direction of the first roller and second roller back to the common first direction;

refeeding the media sheet from the first roller to the second roller and through the print zone with the media sheet second edge as the lead edge; and printing on a second side of the media sheet within the print zone during the refeeding step.

13. The method of claim 12, further comprising between the step of moving the third roller into the second position and the step of changing direction of the first roller and second roller back to the common first direction, the step of sensing an edge of the media sheet with the sensor.

14. A media sheet handling method for printing on two sides of a media sheet, comprising the steps of:

feeding the media sheet with a first roller along a first path onto a second roller, wherein during the step of feeding the first roller and second roller rotate in a common first direction;

advancing with the second roller at least a portion of the media sheet through a print zone, wherein a first edge of the media sheet is a lead edge and a second edge of the media sheet is a trail edge during said feeding and rotating steps;

discontinuing rotation of the second roller in the first direction while a portion of the media sheet remains in contact with the second roller;

moving a refeed guide into the first path to block the first path in a region between the first roller and the second roller;

changing direction of the first roller and second roller to a second direction opposite the first direction;

moving the media sheet back toward the refeed guide, wherein the refeed guide directs the media sheet along a second path onto an inner guide;

advancing, under the force of the second roller, the media sheet along the second path between the inner guide and a third roller, wherein the third roller is located adjacent to the second roller and the inner feed guide, the third roller movable between a first position out of contact with the second roller and a second position in contact with the second roller, wherein the third roller is in the first position during the step of advancing the media sheet along the second path;

after the step of advancing the media sheet along the second path, moving the third roller into the second position, which in turn causes the media sheet to reverse direction along the second path and move toward and onto the first roller; and after the media sheet clears the inner guide, changing direction of the first roller and second roller to the first direction; and refeeding the media sheet from the first roller to the second roller and through the print zone with the media sheet second edge as the lead edge.

* * * * *